United States Patent [19]

Tanaka et al.

[11] Patent Number: 4,518,123

[45] Date of Patent: May 21, 1985

[54] METHOD FOR CONTROLLING THE PULVERIZATION AND DRYNESS OF FLAMMABLE MATERIALS PASSING THROUGH A PULVERIZER, AND METHOD OF CONTROLLING THE PULVERIZING RATE OF THE PULVERIZER

[75] Inventors: Kazuo Tanaka, Kobe; Kenjiro Motonaga, Nishinomiya; Kozo Tanaka, Miki, all of Japan

[73] Assignee: Kobe Steel, Limited, Kobe, Japan

[21] Appl. No.: 632,694

[22] Filed: Jul. 23, 1984

Related U.S. Application Data

[63] Continuation of Ser. No. 462,716, Feb. 1, 1983.

[51] Int. Cl.[3] ..... F23K 1/00

[52] U.S. Cl. ..... 241/18; 110/186; 110/232; 110/347; 241/30; 241/33

[58] Field of Search ..... 110/186, 218, 219, 222, 110/224, 232, 342, 346, 347; 241/18, 30, 33, 34, 57, 60, 48

[56] References Cited

U.S. PATENT DOCUMENTS

| | | | |
|---|---|---|---|
| 1,385,477 | 7/1921 | Hamilton | 33/78 R |
| 1,576,335 | 3/1926 | Kreisinger | 241/17 |
| 1,628,609 | 5/1927 | Newhouse | 110/106 |
| 1,898,086 | 2/1933 | Frisch | 241/33 |
| 2,212,125 | 8/1940 | Peebles | 110/109 |
| 2,291,618 | 8/1942 | Frisch | 83/9 |
| 2,335,853 | 12/1943 | Frisch | 82/35 |
| 2,403,976 | 7/1946 | Harvey | 241/34 |
| 2,419,436 | 4/1947 | Boho | 241/34 |
| 2,427,903 | 9/1947 | Crites | 241/33 |
| 2,916,215 | 12/1959 | Weston et al. | 241/34 |
| 2,998,200 | 8/1961 | Litwinoff | 241/33 |
| 3,043,525 | 7/1962 | Gilbert | 241/30 |
| 3,092,337 | 6/1963 | Patterson | 241/34 |
| 3,167,421 | 1/1965 | Pfeiffer et al. | 110/347 |
| 3,477,650 | 11/1969 | Williams | 34/72 |
| 3,565,349 | 2/1971 | Deynat | 241/42 |
| 3,610,594 | 10/1971 | Williams | 263/15 |
| 3,826,208 | 7/1974 | Williams | 110/224 |
| 3,854,666 | 12/1974 | Switzer, Jr. | 241/18 |
| 4,053,113 | 10/1977 | Rosenstock et al. | 241/30 |
| 4,177,950 | 12/1979 | Smith | 241/33 |
| 4,177,951 | 12/1979 | Makuch | 241/35 |
| 4,184,640 | 1/1980 | Williams | 241/34 |
| 4,193,554 | 3/1980 | Ansen et al. | 241/19 |
| 4,226,371 | 10/1980 | Willams | 241/31 |
| 4,270,466 | 6/1981 | Ansen et al. | 110/232 |
| 4,315,734 | 2/1982 | Ramesohl et al. | 110/347 |
| 4,402,462 | 9/1983 | Lohnherr | 241/34 |

*Primary Examiner*—Edward G. Favors
*Assistant Examiner*—Steven E. Warner
*Attorney, Agent, or Firm*—Oblon, Fisher, Spivak, McClelland & Maier

[57] ABSTRACT

In a method of controlling the pulverization and dryness of a flammable material such as coal, the system is provided with both a push blower upstream from the pulverizer and a pull blower downstream from the pulverizer. The system is controlled so as to maintain the pressure within the pulverizer at an average equal to substantially the atmospheric pressure. In the method for controlling the pulverizing rate, a preset desired differential pressure across the pulverizer is maintained constant while the pulverizing motor speed and the pulverizing material feed rate are modified.

7 Claims, 5 Drawing Figures

METHOD FOR CONTROLLING THE PULVERIZATION AND DRYNESS OF FLAMMABLE MATERIALS PASSING THROUGH A PULVERIZER, AND METHOD OF CONTROLLING THE PULVERIZING RATE OF THE PULVERIZER

This application is a continuation of application Ser. No. 462,716, filed Feb. 1, 1983.

BACKGROUND OF THE INVENTION

1. Field of the Invention

The present invention relates to a method of controlling the pulverization and drying of flammable materials, such as coal, in a system including a pulverizer. The invention also relates to a method of controlling the pulverizing rate of the pulverizer over a wide range.

Generally, in the case of pulverizing a flammable material such as coal, there is adopted a method wherein a high temperature dry gas for removing moisture contained in the material is fed into a pulverizer to preheat and dry the pulverized coal and at the same time the pulverized coal is conveyed pneumatically to a predetermined place by the dry gas. In the case of practicing such a method, there is a danger of the pulverized coal exploding in an atmosphere wherein the oxygen concentration is in the range of 10 to 13% or higher. Therefore, in order to avoid such a danger, it is necessary that the oxygen concentration of the dry gas be held below the concentration at which the coal dust may explode.

Therefore, an inert gas or an exhaust combustion gas is usually used as the dry gas, and in many cases, it has been mixed with a temperature regulating air or exhaust gas having an oxygen content in a range below the above-mentioned oxygen concentration.

As possible methods of operation in such a pulverizing and drying system, there are the positive pressure method for maintaining the interior of the system at a positive pressure and the negative pressure method for maintaining it at a negative pressure. In the former, the operation and control are performed by a push-blower mounted at the inlet of the system for pushing dry gas into the system. In the latter, a pull-blower is mounted at the outlet of the system for sucking out dry gas. However, these methods involve the following problems, and have been unsatisfactory. That is, the positive pressure method creates a positive pressure in the system such that the dry gas and the pulverized coal may leak out of the system, resulting not only in a lack of oxygen in the surrounding environment due to the dry gas, but also a danger of a secondary explosion due to the leakage of the pulverized coal. The negative pressure method is also disadvantageous in that air is likely to leak inside of the system through the rotating and piercing portions of the pulverizer, or the coal supply equipment, thus resulting in increased oxygen concentration within the system, which may cause an explosion of coal dust within the pulverizer.

The pulverized and dried coal is typically supplied to a boiler having a feedback control based upon the demand of the boiler for the pulverized coal as fuel. The amount of pulverized coal required is not constant over time and, as the case may be, the minimum demand is as low as $\frac{1}{3}$ or less than the maximum demand. Therefore, in operating the pulverized coal preparation system, it is necessary to construct a system so that the coal feed rate is automatically controlled by the appropriate feedback from the boiler, or other final use.

In the conventional system, the pressure drop or differential pressure across the pulverizer was measured, and the rate of coal feed into the pulverizer was modified in accordance with this pressure drop. Thus, the control of the feed into the pulverizer in the conventional system was performed so that the amount of coal remaining in the pulverizer was always constant, since the pressure drop across the pulverizer was proportional to the amount of coal within the pulverizer. During normal operation, a differential pressure through a loop connected between the inlet end and the outlet end of the pulverizer was measured and its deviation from a preset differential pressure value was determined. The coal feed rate was controlled by this deviation. Where it was desired to positively change the coal pulverizing rate, it was necessary to change the preset value of the differential pressure to match a preset value corresponding to the desired coal pulverizing rate. The resulting differential pressure deviation then acted upon the controller for the coal feed and varied the coal feed rate.

However, in such a conventional system, the control of the coal pulverizing rate was made, not by regulating the pulverizing motor speed of the pulverizer, itself, but by simply adjusting the coal feed rate in accordance with the increase or decrease of the amount of raw materials staying in the pulverizer. Therefore, the controllable range for the coal pulverizing rate was narrow and the ratio of the maximum pulverizing coal rate to the minimum coal pulverizing rate was only about 1.5 to 2, at most.

SUMMARY OF THE INVENTION

It is an object of the present invention to provide a method for controlling the pulverization and dryiness of a flammable material such as coal, while overcoming the above shortcomings of the prior art.

It is a further object of the invention to provide a control method for a pulverizer which is capable of expanding the control range for the coal pulverizing rate, to the greatest extent possible.

According to one aspect of the invention, a main dry gas and a temperature regulating gas are mixed in advance and the resulting mixed gas is fed under pressure as a dry gas into a flammable material pulverizer by means of a push-blower to preheat and dry the flammable material within the pulverizer. Then, the dry gas, together with the pulverized flammable material, is discharged from the pulverizer and the pulverized flammable material is conveyed pneumatically into a dust collector by means of a pull-blower. The pulverized material is then separated from the dry gas by means of a dust collector. According to the invention, there is performed a pressure control step for the dry gas, comprising measuring the average pressure of the dry gas in the pulverizer and at an inlet or outlet portion of the pulverizer and adjusting the suction damper of the pull-blower to maintain the average pressure of the dry gas in the pulverizer at substantially atmospheric pressure. There is also simultaneously performed a flow rate control for the dry gas, comprising measuring the flow rate of the dry gas at the inlet portion of the pulverizer, and adjusting the forced flow rate of the main dry gas by means of the push-blower to maintain the flow rate of the dry gas at a constant value. There is also simultaneously performed a temperature control for the dry gas, comprising measuring the temperature of the dry gas at the outlet portion of the pulverizer and adjusting the mixing ratio of the temperature regulating gas to the main dry gas so as to keep the temperature of the mixed dry gas at the outlet portion of the pulverizer constant.

According to another aspect with the present invention, the feed rate of the flammable material, such as coal, into the pulverizer is positively increased or decreased without changing a preset differential pressure measured across the pulverizer. Since a change in the coal feed rate will change the pressure drop across the pulverizer, this differential pressure across the pulverizer is detected by a pressure difference controller (PdC), and the speed of the pulverizing motor is changed so as to return this differential pressure to the preset level. Alternatively, the motor speed of the motor turning the pulverizer is changed to vary the differential pressure across the pulverizer, and then the feed rate is changed so as to return the differential pressure to the preset level. Thus, not only is it possible to maintain an optimum differential pressure (pressure drop) across the pulverizer without changing the preset value of the differential pressure, but since the control is made by positively changing either the feed rate or the pulverizing capacity (rotating speed of the pulverizer motor), the control range for the pulverizing rate is also greatly expanded.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 1:
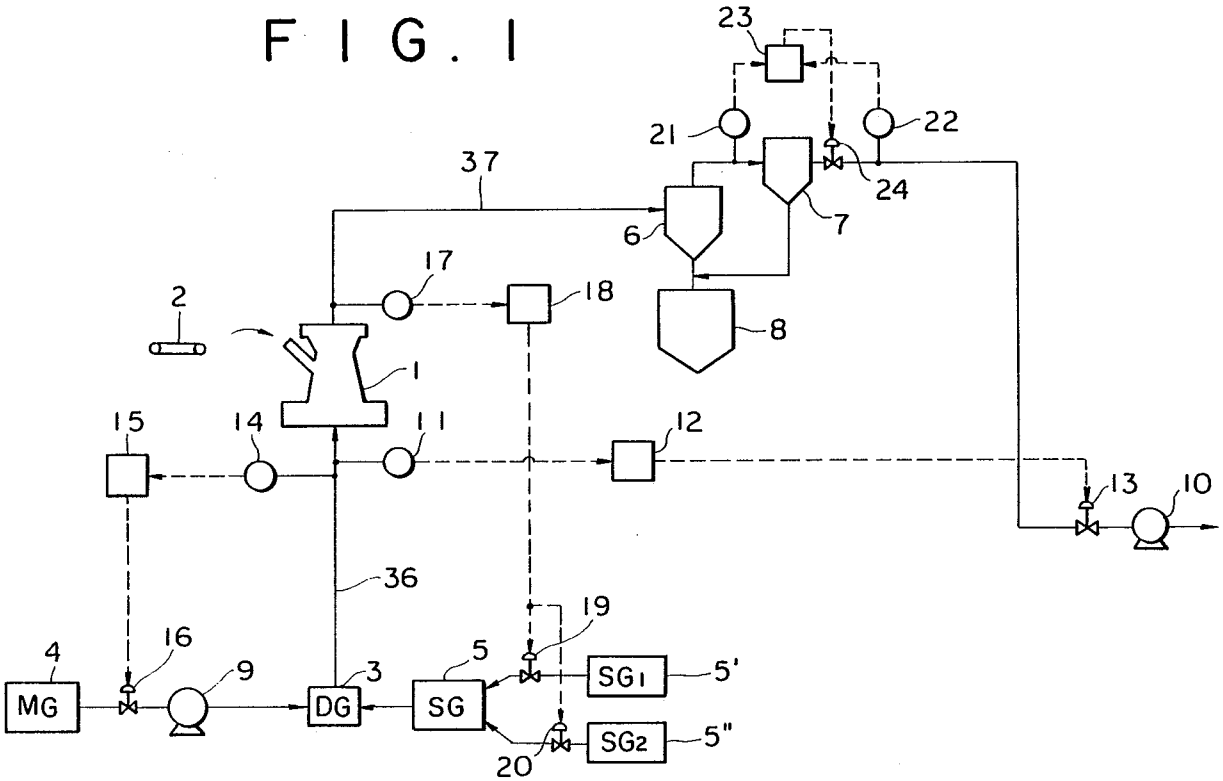
FIG. 1 is a schematic illustration of one embodiment of a system for controlling the pulverizing, drying and pneumatic conveying of coal according to the present invention.

The reference numeral 1 designates a coal pulverizer such as a bowl mill. Coal is charged into the pulverizer via a belt conveyor 2 and pulverized to a desired particle size (e.g. particle sizes with 80% being 200 mesh or below). The pulverizer has a gas inlet on one side and a gas outlet on the other side. A preheating, drying and pneumatically conveying gas, i.e., the mixed gas 3 (hereinafter referred to simply as "dry gas") held at a high temperature is fed from inlet line 36 through the gas inlet into the pulverizer to preheat and dry the pulverized coal, thereby decreasing the moisture content thereof down to a target value (about 1%) or less. At the same time the pulverized coal, while being classified and separated, is discharged and pneumatically conveyed, together with the dry gas from the gas outlet, through line 37 to a dust collector. The dust collector consists of a cyclone 6 and a bag filter 7. The greater part of the pulverized coal which has been conveyed together with the dry gas is collected and separated by the cyclone 6 and then fed to a coal-bin 8 and stored therein. The dry gas, after further collection of fine coal particles in the bag filter 7, is discharged as a clean gas into the atmospheric air. The fine coal particles collected by the bag filter 7 are recovered into the coal-bin 8.

In the method of the present invention, the dry gas and the pulverized coal are conveyed by two blowers which are a push-blower 9 and a pull-blower 10 disposed at inlet and outlet ends, respectively, of a closed interior of the system.

The push-blower 9 functions to feed the dry gas into the pulverizer 1, while the pull-blower 10 functions to suck the dry gas fed into the pulverizer, and the pulverized coal conveyed together with the dry gas, out of the pulverizer into the dust collector and to discharge a clean gas, obtained after collection of the coal dust, into the atmosphere. An important feature of the method of the present invention resides in controlling the pressure within the pulverizer 1, from which the intra-system gas may leak out, and into which the extra-system gas may enter. The pressure within the pulverizer is maintained substantially at atmospheric pressure by combining the "push-pull" functions of both blowers. More specifically, this control-pressure is set so that the pressure (over ambient atmospheric pressure) at the central part of the pulverizer is in the range of $-10$ mm $H_2O$ to $+10$ mm $H_2O$ which corresponds to 0 to $+400$ mm $H_2O$ at the gas inlet portion and $-400$ to 0 mm $H_2O$ at the gas outlet portion.

The dry gas 3 is obtained by mixing, in an appropriate ratio, a main gas 4 with a temperature regulating gas 5. The main dry gas 4 comprises an inert gas such as preheated $N_2$ and/or $CO_2$, or an exhaust flue gas discharged from various combustion furnaces or firing furnaces, and its oxygen concentration is held below 10 to 13% in order to prevent the possible explosion of coal dust. The temperature regulating gas 5 is for regulating the temperature of the dry gas according to feed rate and moisture content of coal, and as the temperature regulating gas 5 there is utilized an exhaust flue gas produced by the combustion of a mixture of a fuel gas 5' and combustion air 5''.

The pressure control for the interior of the pulverizer 1 according to the method of the present invention is performed in the following manner. A pressure meter 11 is provided on the inlet or outlet side (the inlet side in the embodiment of the Figure) of a gas supply duct of the pulverizer 1 to measure at all times the pressure of the dry gas at this portion, and a measured pressure value signal is transmitted to a dry gas pressure control section 12. In the control section 12, the measured value is compared with a preset value (e.g. 0 to $+400$ mm $H_2O$) and when it deviates from the preset value, the opening of a damper 13 disposed before the pull-blower 10 is changed, whereby the inlet pressure of the pulverizer is automatically adjusted so that the pressure within the pulverizer assumes a value in the preset range. More specifically, when the measured value on the pressure meter 11 is higher than the preset value, the opening of the damper 13 is increased to increase the gas volume of the pull-blower 10, whereas when the measured value is smaller than the preset value, the opening of the damper 13 is decreased to decrease the gas volume of the pull-blower 10. Consequently, by this pressure control, the average pressure within the pulverizer 1 is always maintained at the desired level, that is, substantially at atmospheric pressure, whereby the leak-in of the extra-system air and the leak-out of the intra-system gas and pulverized coal can be prevented.

In the method of the present invention, moreover, there is provided a control for the flow rate of gas at the inlet side of the pulverizer 1 in addition to the above-mentioned pressure control. More specifically, a flow meter 14 is also provided in the gas supply duct on the inlet side of the pulverizer 1, whereby the flow rate of the dry gas being continuously fed into the pulverizer 1 is measured, and the measured signal is transmitted to a flow rate control section 15. In the flow control section 15, the measured value on the flow meter 14 is compared with a preset value of the gas flow rate which is set in advance in conformity with the capacity of the pulverizer 1 and the desired particle size of the pulverized coal taken out of the pulverizer 1 together with the dry gas. When the measured value is outside the preset range, the opening of a damper 16 disposed before the push-blower 9 is changed to adjust the flow rate of the main dry gas 4, whereby the flow rate of the dry gas 3 fed to the pulverizer 1 is controlled to become constant within the range of the preset value. In this case, when the measured value is larger than the preset value, the opening of the damper 16 is decreased, whereas when it is smaller than the preset value, the opening of the damper 16 is increased. In this way, the flow rate of the dry gas 3 fed to and discharged from the pulverizer 1 is maintained constant. As a result, the classifying performance in the pulverizer is stabilized, thus permitting pulverized coal of the desired particle size to be obtained with a high accuracy.

In the method of the present invention, moreover, in addition to the described pressure control and flow rate control, there is simultaneously performed a temperature control for the dry gas. More specifically, a thermometer 17 is provided in a discharge duct on the outlet side of the pulverizer 1 to measure the temperature of the dry gas after fulfilling its preheating and drying function within the pulverizer, and the measured temeprature value is transmitted to a temperature control section 18. In the temperature control section 18, the measured value on the thermometer is compared with a preset value of the gas temperature (e.g. 70° to 90° C.) which is set in advance in conformity with a desired moisture content of the pulverized coal to be stored as product in the coal bin 8. When the measured value deviates from the preset value, the mixing ratio of the temperature regulating gas 5 to the main dry gas 4 is changed to adjust the temperature of the dry gas 3, and on the basis of this adjustment the gas temperature at the outlet side of the pulverizer 1 is controlled to be held in the preset range. More particularly, when the measured value on the thermometer 17 is larger than the preset value, the opening of flow control valves 19 and 20 for the fuel 5' and combustion air 5'' is decreased to decrease the mixing ratio of the temperature regulating gas 5 to thereby lower the temperature of the dry gas. When such measured value is smaller than the preset value, the opening of the flow control valves 19 and 20 is increased, whereby the mixing ratio of the temperature regulating gas 5 is increased to raise the temperature of the dry gas. By such a temperature control for the dry gas, even when the moisture content of coal fed to the pulverizer changes, it is possible to lower the moisture content of the pulverized coal as product to a desired value stably and efficiently.

In performing the pressure control for the pulverizer, the pressure loss of the bag filter 7 varies periodically from the minimum pressure loss just after sweeping-away the pulverized coal adhered and accumulated onto the filter (by a non-illustrated back flow system) up to the maximum pressure loss just before the sweeping-away of the pulverized coal, and this gives rise to a disturbance in the pressure control system. In order to remove such a distubrance and to effect a more efficient pressure control, it is preferable that there be performed the following differential pressure compensating control steps for the bag filter.

Differential pressures on either side of the bag filter 7 are measured by pressure meters 21 and 22 which are disposed on the inlet and outlet sides, respectively, of the filter 7, and the measured pressure signals are sent to a differential pressure compensating control section 23. In the control section 23, a differential pressure calculated from both measured values is compared with a preset value (e.g. 100 to 150 mm $H_2O$), and when it is outside the range of the preset value, the opening of a damper 24 disposed before the detection port of the pressure meter 22 is adjusted so that the differential pressure based on the measurement takes a value within the range of the preset value. When the value of differential pressure based on the measurement is larger than the preset value, the opening of the damper 24 is increased, whereas when it is smaller than the preset value, the opening of the same damper is decreased. By such a differential pressure compensating control, the foregoing disturbance to the pressure control system caused by variations in the pressure loss of the bag filter is removed.

Although in the described embodiment, the pull-blower is disposed downstream of the bag filter 7, the present invention is not limited thereto. There may be adopted an arrangement such that the pull-blower is disposed between the cyclone 6 and the bag filter 7.

Figure 2:
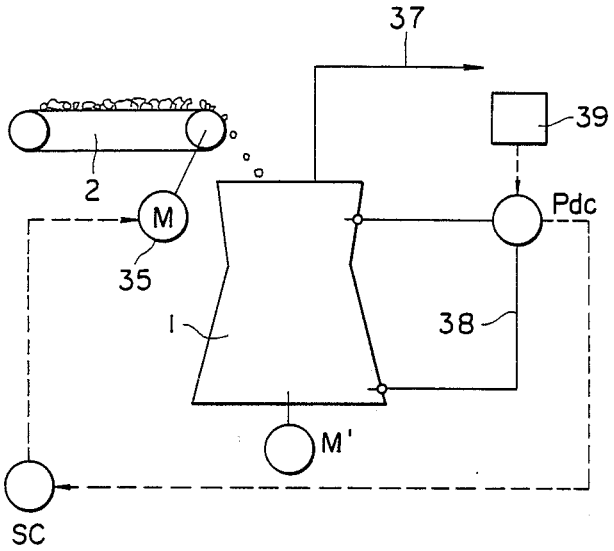
FIG. 2 PRIOR ART
FIG. 2 is a schematic view of a pulverizer together with the conventional means for controlling the pulverizing rate thereof.

FIG. 2 schematically shows the conventional pulverizing rate controller for the pulverizer 1. It is conventional to provide a loop 38 between the inlet end and the outlet end of the pulverizer for measuring the differential pressure thereacross. It is conventional to provide a pressure difference controller (PdC) in loop 38. The PdC is also fed with a preset differential pressure from a controller 39. The raw coal is fed into the pulverizer from a feeding device such as the conveyor 2. The motor 35 of the conveyor 2 is controlled by a speed control SC, whose operation is, in turn, controlled by a signal from the PdC. The pulverizer itself is rotated by a motor M' It is possible for the inlet end of the PdC to serve as the pressure meter 11 of FIG. 1.

It is conventional to control the above system so that the amount of raw material remaining in the pulverizer 1 is always constant. Since the differential pressure is proportional to the amount of material in the pulverizer, during normal operation, the pressure drop, or differential pressure, across the pulverizer 1 is measured and its deviation from the preset differential pressure from controller 39 is measured. Any such deviation causes a signal to be sent from the PdC to the SC which controls the conveyor motor 35. For example, if the PdC measures a differential pressure which is too high, as compared to the preset differential pressure indicating too much coal in the pulverizer, the PdC sends a signal to the SC requiring a reduction in the speed of the motor 35. This assures a stable operation of the pulverizer.

If it is desired to positively change the coal pulverizing rate, the preset value from controller 39 is altered to a differential pressure corresponding to the desired coal pulverizing rate. This results in an initial deviation signal from the PdC, which, in turn, modifies the rate of motor 35, through the SC. In such a conventional system, however, the control of the coal pulverizing rate is narrow so that the ratio of the maximum coal pulverizing rate to the minimum coal pulverizing rate is only 1.5 to 2 at most.

Figure 3:
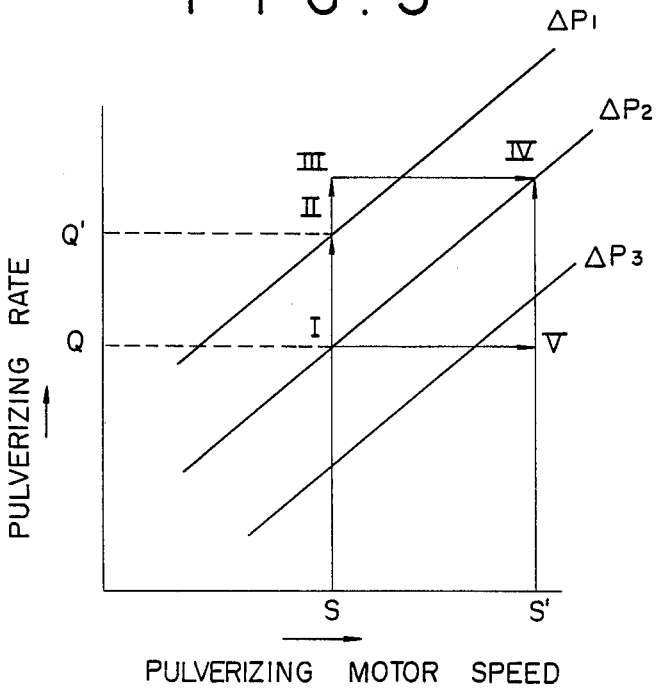
FIG. 3 is a graph comparing the method of the present invention with the conventional method.

FIG. 3 graphically compares the principle of the present invention with the conventional method shown in FIG. 2, wherein the pulverizing rate and the pulverizing motor speed are plotted along the axis of ordinate and the axis of absicissa, respectively, and each of the straight lines shows the relationship between the motor speed and the pulverizing rate at a preset differential pressure. As shown therein, the motor speed and the pulverizing rate are in a proportional relation, and if the preset differential pressures are regarded as parameters, then it is seen that in the case of larger preset differential pressure ($\Delta P_1 > \Delta P_2 > \Delta P_3$), the pulverizing rate is larger even with the same motor speed, and the pulverized coal is conveyed away successfully.

In a normal operation of the conventional control system, for example, at a preset differential pressure of $\Delta P_2$, a pulverizing motor speed of S and a pulverizing rate of Q (the state of point I), if it is desired to raise the pulverizing rate to Q', a preset differential pressure $\Delta P_1$ at which the pulverizing rate is Q' at the speed S, is calculated and the preset differential pressure through the nozzle is changed to $\Delta P_1$ (the state of point II). Since at this initial time the actual differential pressure remains close to $\Delta P_2$, there occurs the difference of $\Delta P_1 - \Delta P_2$ with respect to the preset differential pressure $\Delta P_1$. In the conventional method, therefore, the feed rate is increased until the actual pulverizing rate reaches Q' (until $\Delta P_1 = \Delta P_2$). That is, control is made by moving the differential pressure from point I to point II and constant speed S. Consequently, an attempt to further increase the pulverizing rate requires a further increase of the preset differential pressure $\Delta P_1$, thus leading to deterioration of the control accuracy during the subsequent interim period as the pulverizing rate approaches the desired rate.

On the other hand, in the present invention, the preset differential pressure itself is fixed to a value which is desirable from the aspect of control accuracy, e.g. $\Delta P_2$ (the state of point I). In addition, there is adopted one of the following:

(1) A method wherein the feed rate is increased to match the desired pulverizing rate without changing the pulverizing motor speed (the state of point III). Subsequently, the difference between the measured differential pressure at that time and the preset differential pressure $\Delta P_2$ is detected and the motor speed is increased until this difference becomes zero (the state of point IV), or (2) A method wherein the pulverizing motor speed is increased without changing the feed rate (the state of point V). The difference between the measured differential pressure at that time and the preset differential pressure $\Delta P_2$ is then detected and the feed rate is increased until this difference becomes zero (the state of point IV).

In case it is desired to decrease the pulverizing rate, control may be made in the direction in which the pulverizing motor speed is decreased, opposite the abovementioned control.

Thus, the conventional control system relies mainly on adjustment of the feed rate and does not combine it with adjustment of the pulverizing motor speed, while in the present invention, the pulverizing capability itself is controlled by adjustment of the pulverizing motor speed, whereby the pulverizing rate can be controlled over a wide range.

Figure 4:
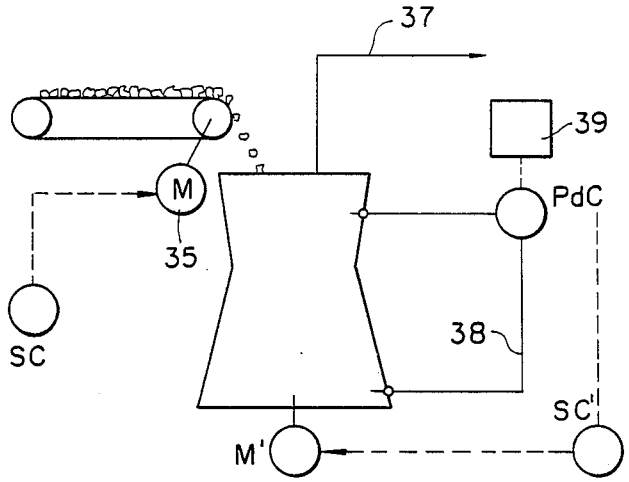
FIG. 4 is a schematic view of one embodiment of the control system for the pulverizing rate according to the present invention.
Figure 5:
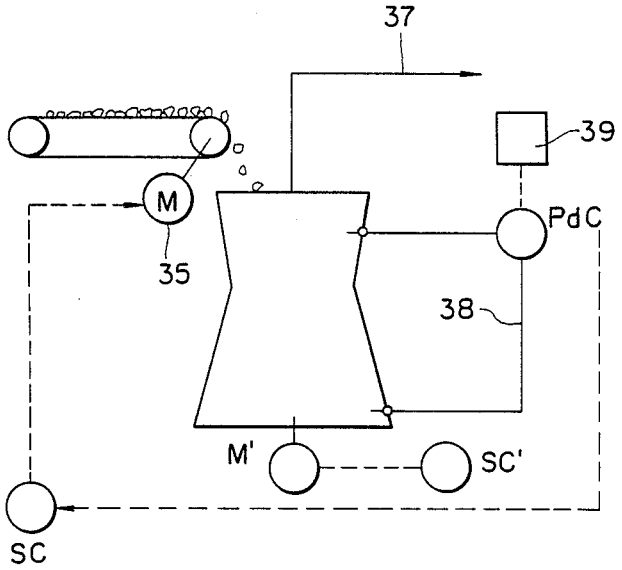
FIG. 5 illustrates a second embodiment of the method of FIG. 4.

FIGS. 4 and 5 are schematic illustrations of the apparatus for practicing the control system of the present invention. FIG. 4 shows the first system in which the feed rate is changed and the pulverizing motor speed is controlled accordingly. FIG. 5 shows the second system in which the pulverizing motor speed is changed and the feed rate is controlled accordingly. More specifically, in FIG. 4 the control system is constructed in such a manner that the pressure difference controller PdC and the speed controller SC for the motor 35 disposed on the driving side of the raw material feeding device 2 are made independent. A signal from the pressure difference controller PdC is instead fed to the speed controller SC' of the pulverizing motor M'. In the embodiment of FIG. 5, the control system is constructed such that a rotational speed matching a desired pulverizing rate is set for the speed controller SC' for the pulverizing motor M', and a signal from the pressure difference controller PdC is fed to the speed controller SC for the motor 35 on the driving side of the raw material feeding device 2.

According to this aspect of the present invention, as set forth hereinabove, the pressure control for the dry gas is performed in pulverizing, drying and pneumatically conveying flammable material such as coal, whereby the leakage of air into the system and the leakage of the dry gas and pulverized material to the exterior of the system can be prevented. This eliminates the danger of explosion of coal dust caused by an increase of the oxygen concentration within the system as well as the possibility of a lack of oxygen and a secondary explosion at the exterior of the system; that is, a safe operation can be ensured, and the classifying performance of the pulverizer can be stabilized by the flow rate control for the dry gas, and further moisture contained in the pulverized material can be removed efficiently by the temperature control for the dry gas. Thus, according to the present invention there are provided these superior effects.

The present invention is also constructed as above wherein the pulverizing capability of the pulverizer is adopted directly as one control factor, and consequently the control range for the pulverizing rate can be expanded to a large extent. Furthermore, the present invention is applicable not only to the field of coal pulverizing but also widely to all of the pulverization systems connnected to pneumatic conveying systems for powders.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for controlling a system of pulverizing and drying a flammable material, said method comprising:

supplying said flammable material to a pulverizer operated by a pulverizer motor;

mixing a main dry gas and a temperature regulating gas to form a mixed gas;

using a push blower to feed said mixed gas into said pulverizer, so as to dry said material;

using a pull blower having a suction damper to discharge a mixture of said mixed gas and pulverized material to a separator;

performing a pressure control step of measuring the pressure of said mixed gas to one on an inlet or an outlet of said pulverizer and adjusting one of said blowers in response to said measured pressure so as to maintain the average pressure in said pulverizer substantially at atmospheric pressure;

performing a flow rate control step of measuring the flow rate of said mixed gas through said pulverizer and adjusting the forced flow rate of another of said blowers in response to said flow rate measurement so as to maintain the flow rate of said mixed gas at a constant value;

performing a temperature control step of measuring the temperature of said mixed gas at said outlet portion of said pulverizer and adjusting the mixing ration of said temperature regulating gas to said main dry gas in response to said measured temperature so as to maintain said measured temperature at a constant value.

2. The method of claim 1 including the step of performing a temperature control step of measuring the temperature of said mixed gas at said outlet portion of said pulverizer and adjusting the mixing ratio of said temperature regulating gas to said main dry gas in response to said measured temperature so as to maintain said measured temperature at a constant value.

3. The method of claim 1 including the pulverizing rate control step of controlling the pulverizing rate of said pulverizer by:

varying the rate at which said material is fed to said pulverizer;

detecting a resulting change in the differential pressure through said pulverizer; and controlling the speed of said pulverizer motor until said differential pressure coincides with a preset value thereof.

4. The method of of claim 1 including the pulverizing rate control step of controlling the pulverizing rate of said pulverizer by:

varying the speed of said pulverizer motor;

detecting a resulting change in the differential pressure through said pulverizer; and controlling the rate at which said material is fed to said pulverizer until said differential pressure coincides with a preset value thereof.

5. A method of controlling the pulverizing rate of a pulverizer, comprising:

supplying a flammable material to said pulverizer;

using a pulverizer motor to operate said pulverizer;

supplying a gas to one end of said pulverizer;

discharging said gas and pulverized material from a second end of said pulverizer;

using a pressure difference controller to detect a differential pressure between said ends of said pulverizer;

emitting a signal from said pressure difference controller, said signal being proportional to a deviation of said detected differential pressure from a preset differential pressure;

varying the rate of one of said flammable material supply and said pulverizing motor while maintaining said preset differential pressure at a constant value; and feeding said signal corresponding to a resulting differential pressure deviation to the other of said flammable material supply and said pulverizer motor, until said deviation becomes zero.

6. The method of claim 5 wherein said step of feeding said signal comprises feeding said signal to said flammable material supply.

7. The method of claim 5 wherein said step of feeding said signal comprises feeding said signal to said pulverizer motor.

* * * * *